US007832582B2

(12) United States Patent
Roubal et al.

(10) Patent No.: US 7,832,582 B2
(45) Date of Patent: Nov. 16, 2010

(54) ASEPTIC STRUCTURAL RIB FOR PLASTIC CONTAINERS

(75) Inventors: Edward Roubal, Stewartstown, PA (US); Larry Taylor, Landisville, PA (US); Jana Lamberson, York, PA (US)

(73) Assignee: Graham Packaging Company, L.P., York, PA (US)

( * ) Notice: Subject to any disclaimer, the term of this patent is extended or adjusted under 35 U.S.C. 154(b) by 1034 days.

(21) Appl. No.: 11/584,594

(22) Filed: Oct. 23, 2006

(65) Prior Publication Data

US 2008/0093331 A1 Apr. 24, 2008

(51) Int. Cl.
*B65D 1/02* (2006.01)
*B65D 1/46* (2006.01)

(52) U.S. Cl. ..... 215/382; 220/672; 220/675

(58) Field of Classification Search ..... 215/381–383, 215/379, 380, 384; 220/672, 675, 669
See application file for complete search history.

(56) References Cited

U.S. PATENT DOCUMENTS 3,185,353 A * 5/1965 Mercier ..... 222/206
4,610,366 A * 9/1986 Estes et al. ..... 426/106
4,824,787 A * 4/1989 Serkes et al. ..... 435/299.2
4,873,100 A * 10/1989 Dirksing et al. ..... 426/111
5,303,833 A * 4/1994 Hayashi et al. ..... 215/381
5,669,520 A * 9/1997 Simpson ..... 215/11.1
6,065,624 A 5/2000 Steinke
6,112,925 A * 9/2000 Nahill et al. ..... 215/382
D457,060 S * 5/2002 Bretz et al. ..... D9/434
7,347,339 B2 * 3/2008 Bangi et al. ..... 215/381
7,469,796 B2 * 12/2008 Kamineni et al. ..... 215/382
2003/0015491 A1 * 1/2003 Melrose et al. ..... 215/381
2003/0116527 A1 * 6/2003 Beaver et al. ..... 215/382
2006/0032189 A1 2/2006 Giacobbe
2006/0070976 A1 * 4/2006 Ungrady ..... 215/381

FOREIGN PATENT DOCUMENTS

GB 2025889 A * 1/1980

* cited by examiner

*Primary Examiner*—Sue A Weaver
(74) *Attorney, Agent, or Firm*—Knoble Yoshida & Dunleavy, LLC

(57) ABSTRACT

A plastic container includes a neck with an opening, a bell portion surrounding the neck, a body portion including at least one "m"-shaped horizontal rib, and a base where the body portion is located between the bell portion and the base.

10 Claims, 2 Drawing Sheets

ASEPTIC STRUCTURAL RIB FOR PLASTIC CONTAINERS

BACKGROUND OF THE INVENTION

1. Field of the Invention

The present invention relates generally to aseptic structural ribs for plastic containers, and more particularly to structural ribs that prevent ovalization of a plastic container and work with aseptic sterilization of the plastic container formed by blow molding.

2. Related Art

Conventional structural ribs for plastic containers may meet the strength or structural requirement for a plastic container, but cause problems in sterilization of the resultant containers. In order for a plastic container to be filled with food product, an aseptic process is necessary. During this process, a sterilizing agent first must be introduced to all internal portions of the container and then must be removed in accordance with Food and Drug Administration (FDA) requirements. Conventional structural ribs did not address both the structural and aseptic needs of the plastic container.

Consequently, known structural rib shapes or methods of forming a plastic container with the same either provided sufficient rigidity for the plastic container but did not pass the FDA requirements for the aseptic process, or, provided structural ribs with a geometry that allowed the resultant container to pass the FDA requirements after the aseptic process, but failed to provided sufficient rigidity or strength to the plastic container. As a result, known structural ribs cause a number of plastic containers to fail the aseptic process, or, result in plastic containers filled with food product that develop an undesirable ovalization of the container.

Known structural ribs for a plastic container employ a single indentation toward the center of the plastic container. A single structural rib does not provide the necessary hoop strength or rigidity to prevent ovalization and/or compressing of the container side walls during vending. Deeper projections of the single structural rib were thought capable of providing the necessary strength, but failed to hold the shape of the plastic container during vending. That is, the deeper projections did not resist distortion.

What is needed then is an improved plastic container with at least one structural rib that overcomes shortcomings of conventional solutions.

BRIEF SUMMARY OF THE INVENTION

In summary, a blow-molded plastic container was developed that addressed the structural aspect (hoop strength or rigidity) of container performance while balancing that with aseptic requirements to create a structural rib geometry that could be sterilized through the aseptic process. An embodiment of the plastic container of the invention includes a neck with an opening, a bell portion surrounding the neck, a body portion including at least one "m"-shaped horizontal rib, and a base where the body portion is located between the bell portion and the base.

This invention succeeds where previous efforts have failed by providing the additional structure that was needed about the container body in order to eliminate the container from ovalization. This was achieved by recognizing that increasing rib projections into the container caused problems with the sterilizing agent accessing the container underneath the projection and removal of the sterilizing agent according to FDA requirements. The aseptic process, therefore, was a limiting factor in how deep the rib could extend into the package.

Thus, the solution was to change the profile of the rib so that the profile would be friendly to the aseptic process of sterilizing the interior of the container and still provide the necessary hoop strength or rigidity of the plastic container that resists deflection of the container sides during sidewall load, palletizing, or vending.

Another embodiment of the invention is a method of providing hoop strength and sterility in a plastic container. This is achieved by blow molding a plastic container with a neck, bell portion, body portion and base forming an interior, providing the body portion with at least one "m"-shaped horizontal rib to provide sufficient hoop strength thereby eliminating ovalization of a plastic container filled with food product, sterilizing the plastic container with a sterilizing agent, and effectively removing the sterilizing agent wherein the shape of the "m"-shaped horizontal rib provides sufficient structural strength while enabling the sterilizing agent to access all of the interior of the plastic container and enabling effective removal of the sterilizing agent.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention.

Figure 1:
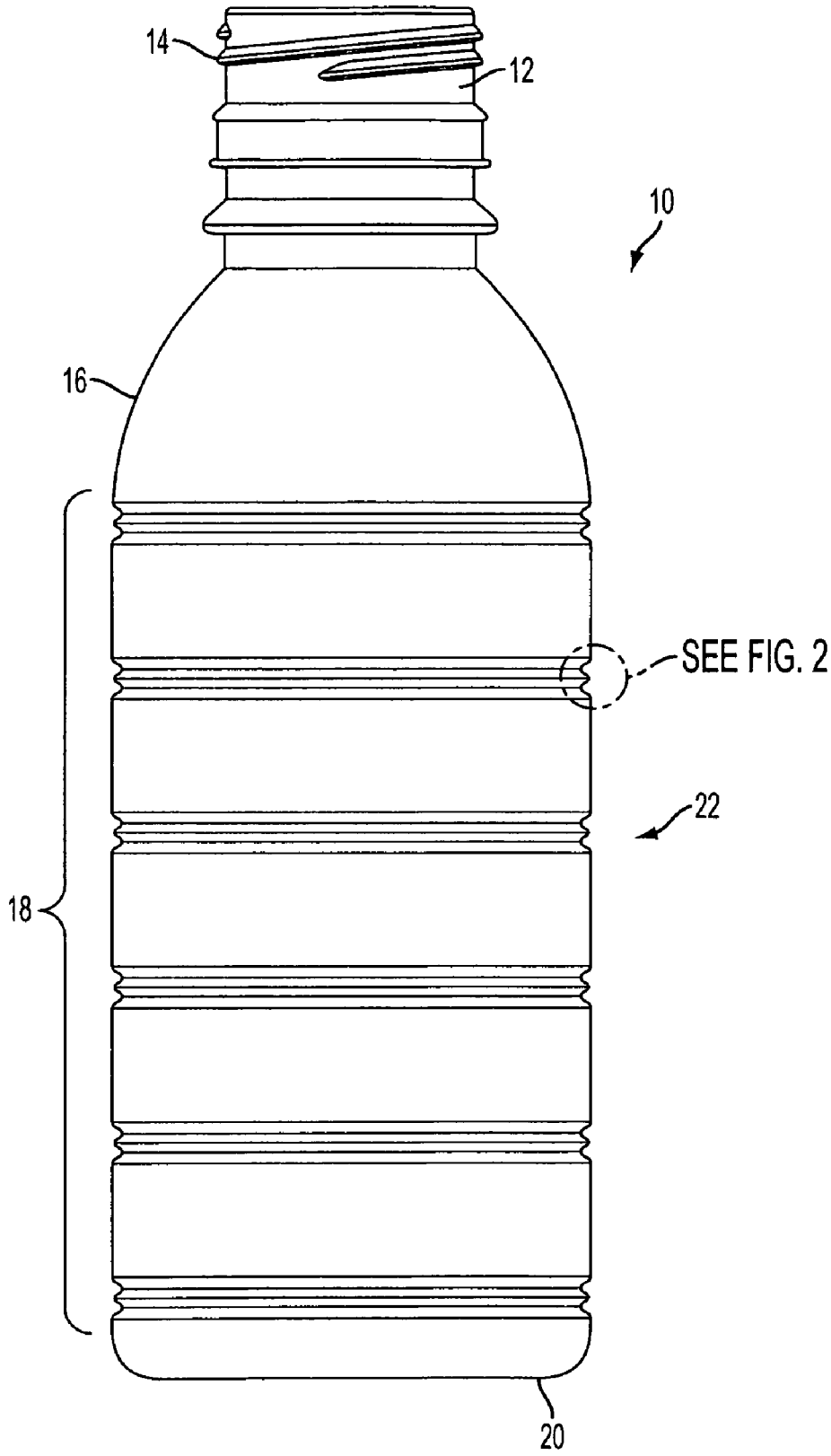
FIG. 1 depicts an exemplary embodiment of a plastic container according to the present invention.

Referring to FIG. 1, a plastic container 10 according to an exemplary embodiment of the invention is shown. The container 10 can be used to package a wide variety of liquid, viscous or solid products including, for example, juices, other beverages, yogurt, sauces, pudding, lotions, soaps in liquid or gel form, and bead shaped objects such as candy. The present container can be made by conventional blow molding processes including, for example, extrusion blow molding, stretch blow molding and injection blow molding.

Container 10 has a neck 12 that surrounds an opening to the interior of container 10. In this example, neck 12 has a finish 14 for receiving a lid that is not shown. A bell portion 16 extends outwardly from the circumference of neck 12 to a body portion 18 where the bell portion 16 and body portion 18 form the sidewalls of container 10. A base 20 is formed at the bottom of body portion 18. The sidewalls of the container 10 determine the amount of volume for adding a product to the container 10.

The body portion 18 may include a number of structural ribs 22. Each structural rib 22 circumscribes body portion 18 along a generally horizontal plane. The number of structural ribs needed to surround the body portion 18 to provide sufficient hoop strength (i.e., resist deflection or distortion of the sidewalls) depends on several factors. For example, the volume of the container (height and width of the body portion), the thickness of the plastic used to blow-molded container 10, and the desired hoop strength to resist deflection of a filled container as it is side loaded, palletized or vended. As structural rib 22 extends around the body portion, it provides hoop strength or rigidity to the sidewalls of body portion 18 of container 10. That is, the generally horizontal structural rib 22 provides the necessary hoop strength so that sidewalls of container 10 resist deflection and do not become compressed during sidewall loading, palletizing or vending.

The sidewalls, as formed, are substantially tubular and can have any cross sectional shape. Cross sectional shapes include, for example, a circular transverse cross section; an oval transverse cross section; a substantially square transverse cross section; other substantially polygonal transverse cross sectional shapes such as triangular, pentagonal, etc.; or combinations of curved and arced shapes with linear shapes. As will be understood, when the container has a substantially polygonal transverse cross sectional shape, the corners of the polygon are typically rounded or chamfered.

Figure 2:
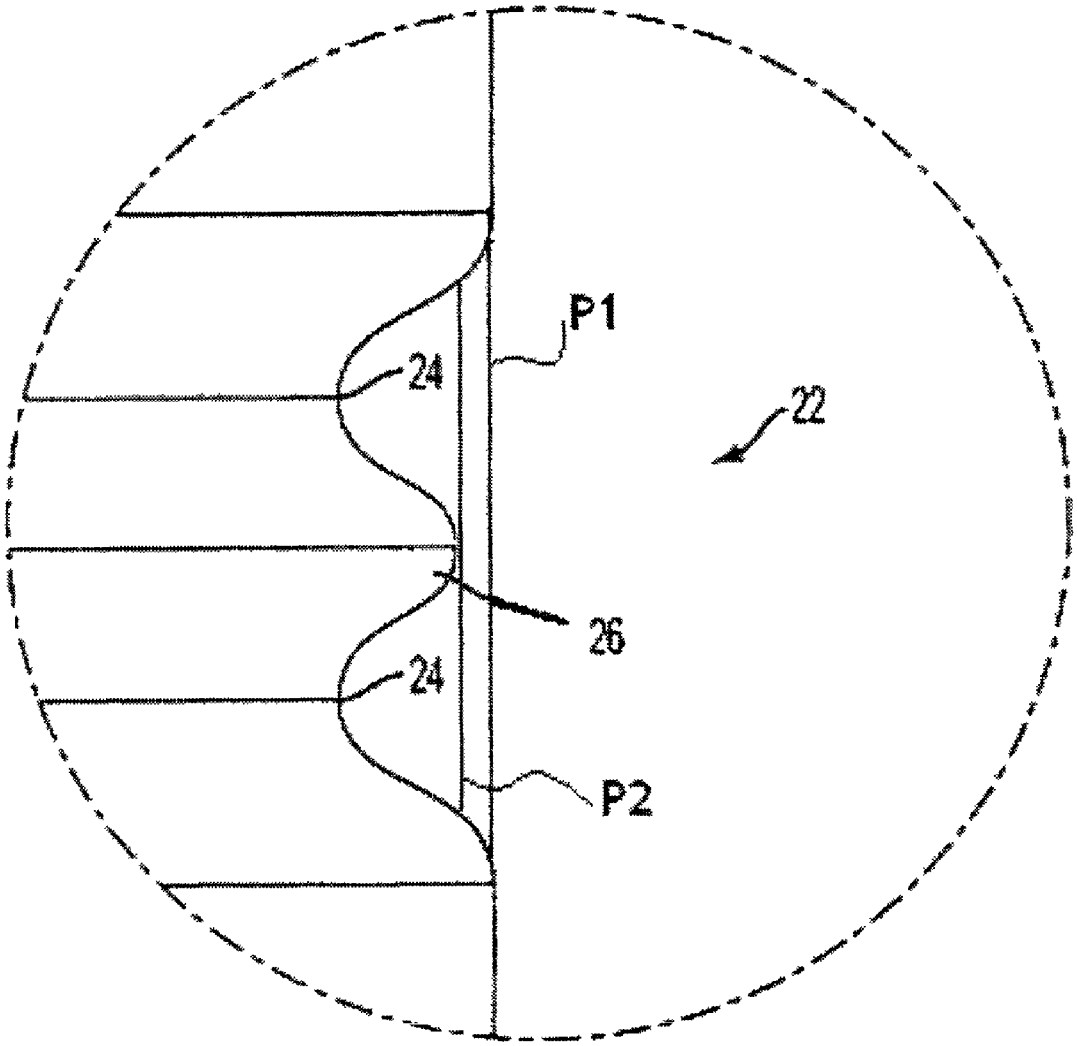
FIG. 2 shows the dashed circled area of FIG. 1 enlarged in a detail to illustrate the "m"-shaped horizontal rib according to one embodiment of the present invention.

FIG. 2 shows the dashed circled area of FIG. 1 enlarged in a detail to illustrate the "m"-shaped horizontal rib 22 according to one embodiment of the present invention. The "m"-shaped horizontal rib is a departure from the single rib with a deeper projection into the container in order to meet the desired hoop strength while still maintaining quality control (containers passing the FDA requirements for sterilization). The "m"-shaped horizontal rib 22 is formed with two rounded indentations 24 projecting into the center of the container on either side of a rounded bump 26 facing the opposite direction (i.e., away from the center of the container). It is this profile of the structural rib that provides sufficient hoop strength while allowing the sterilizing agent to be effectively removed in accordance with FDA requirements.

Indentations 24 are formed so that they are rounded at a vertical plane tangent to or forming part of body portion 18 and projected toward the center of container 10 a distance before angling off to form the rounded indentation 24. In a similar manner, although in the opposite direction and extending from the top of rounded indentation 24, the rounded bump 26 is formed between two indentations 24. However, rounded bump 26 does not extend to the vertical plane tangent to or forming part of body portion 18. Consequently, while indentations 24 project into the container, rounded bump 26 is less deep than a side of indention 24 which projects from the first plane P1 tangent to or forming part of body portion 18. That is, the rounded bump does not reach the first plane P1 tangent to or forming part of body portion 18, as the rounded bump 26 reaches a second plane P2 closer to the center of container 10.

The profile of the "m"-shaped horizontal rib 22 allows the sterilizing agent to access an underside of each indentation 24 and the interior of rounded bump 26. In the same manner, a rinsing solution can effectively remove the sterilizing agent from all parts of the container 10 thereby reducing the number of rejected containers due to the aseptic process of sterilizing the container.

In an exemplary embodiment, the indentations 24 may project into the container approximately 0.045 inch (1.13 mm). The foot of indentation 24 extending inwardly toward the center of the container from body portion 18 may have a radius of approximately 0.027 inch (0.67 mm) where the indentation 24 after being rounded off of the vertical plane tangent to or forming part of body portion 18 extends about 0.034 inch (0.86 mm) to the rounded top of the indentation 24. The rounded top of indentation 24 may have a radius of 0.024 inch (0.60 mm). The rounded bump 26 is blended between the two rounded indentations with an rounded top. The width of the "m"-shaped horizontal rib profile may be around 0.191 inch (4.86 mm) with the tops of the rounded indentations 24 being 0.085 inch (2.17 mm). The radii of the rounded "m"-shaped horizontal rib vary depending upon the size of the rib, the thickness of the container plastic, etc. to create a consistent, proportional "m" style for containers of varying volumes, heights, etc.

The "m"-shaped horizontal rib 24 provides sufficient hoop strength in a position or positions where rigidity does the most good. That is, at least one "m"-shaped horizontal rib 22 is placed in a position along the body portion 18 to provide the strongest hoop strength to the plastic container 10. A container 10 may have a plurality of "m"-shaped horizontal ribs 24 in order to prevent ovalization, which may occur due to a change in temperature of the filled container. The change in temperature could cause the sidewall of the container to pull in toward the center of the container presenting a non-aesthetic appearance. For example, refrigerating a liquid in a plastic container may contract the sidewalls that were originally designed to be round in appearance. However, with the "m"-shaped horizontal rib structure of the exemplary invention, such a container can be provided with sufficient hoop strength or rigidity to resist deflection due to changes in temperature or due to compression in side loading, palletizing or vending. That is, containers with the "m"-shaped horizontal rib or ribs according to the invention are vendable. The "m"-shaped horizontal rib strengthens the sidewalls of a filled plastic container to such a degree that the filled container resists deflection in its sidewalls as it moves through a vending machine maze.

The plastic container 10 may include a shrink wrap film with a label surrounding body portion 18. The shrink film serves two purposes: 1) as a label; and 2) as a covering over the "m"-shaped horizontal rib(s). The "m"-shaped horizontal rib keeps the shrink film from collapsing into the grooves of the "m"-styled indentions due to the rounded bump 26. Thus, the shrink film label is not wrinkled when placed on the container and aesthetically presents the product, as well as ensures that the ingredients, product name and other descriptive legends are clearly presented to the consumer.

The container according to another embodiment of the invention is achieved through a blow molding process. A plastic container 10 is created with a neck 12, bell portion 16, body portion 18 and base 20 forming an interior. Body portion 18 is provided with at least one "m"-shaped horizontal rib 22 that increases the hoop strength of the smooth body portion 18. The increased hoop strength of container 10 resists deflection of the plastic container that results in ovalization or another non-aesthetic appearance. Sterilization of the container 10 can be achieved by adding a sterilizing agent to the container so that it reaches all interior portions of the container and then, rinsing the sterilizing agent out of container 10. The "m"-shaped horizontal rib is designed so that it provides sufficient structural hoop strength while enabling the sterilizing agent to access all parts of the plastic container interior and effective removal of the sterilizing agent to FDA requirements. That is, the "m"-shaped horizontal rib does not capture and retain microbes of the sterilizing agent so that the container fails the FDA requirements and the container is rejected.

The "m"-shaped horizontal rib 22 may be formed while the container 10 is being blow molded. A generally horizontal "m"-shaped horizontal rib is formed about a perimeter of body portion 18 with two rounded indentations 24 pushed inward into the body portion 18 with a rounded bump 26 facing outward between the two rounded indentations 24. The rounded indentations 24 extend on one side from a first plane tangent to or forming part of body portion 18 and the top of the rounded bump 26 between the two rounded indentations reaches a second plane closer to the center of container 10.

The two rounded indentations 24 extend into container 10 a smaller distance than a single indentation that may provide a similar hoop strength. Consequently, the two rounded indentations 24 of the exemplary invention do not have a deep underside into which sterilizing agent must first enter and then be effectively removed by a rinsing agent. That is, the "m"-shaped horizontal rib is of a shape that allows the sterilizing agent to access an underside of the rib 22 and that enables the sterilizing agent to be effectively removed from the plastic container 10 thereby decreasing the rejected containers after the aseptic process.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A plastic container comprising:

a neck with an opening to an interior of the container;

a bell portion surrounding the neck;

a body portion including at least one "m"-shaped horizontal rib;

a base where the body portion is located between the bell portion and the base;

wherein the at least one "m"-shaped horizontal rib forms a hoop around the body portion adding rigidity and the "m"-shaped horizontal rib is formed with two rounded indentations into the body portion with a rounded bump between the two rounded indentations wherein the rounded bump extends from the body portion; and further wherein the two rounded indentations extend from a side of the body portion forming a first plane and the rounded bump between the two rounded indentations extends from the body to a second plane that does not reach the first plane.

2. The plastic container according to claim 1, wherein the at least one "m"-shaped horizontal rib is of a shape that allows a sterilizing agent to access an underside of the rib and that enables the sterilizing agent to be effectively removed from the container thereby improving the aseptic process of sterilizing the plastic container.

3. The plastic container according to claim 1, wherein the hoop strengthens sidewalls of the filled plastic container so that the container resists deflection in its sidewalls as it moves throughout a vending machine maze.

4. The plastic container according to claim 1, wherein the at least one "m"-shaped horizontal rib is placed in a position along the body portion to provide the strongest hoop strength to the plastic container.

5. The plastic container according to claim 1, wherein the body portion has one of a round or square profile.

6. A plastic container comprising:

a neck with an opening to an interior of the container;

a bell portion surrounding the neck;

a body portion located below the bell portion, wherein the body portion has an "m"-shaped horizontally extending rib;

a base located below the body portion;

wherein the "m"-shaped horizontally extending rib is formed by two rounded indentations and a rounded bump located between the two rounded indentations, wherein the two rounded indentations extend from a first plane of the body portion towards the interior of the container and the rounded bump extends away from the interior of the container to a second plane, wherein the second plane is located closer to the interior of the container than the first plane.

7. The plastic container according to claim 6, wherein the "m"-shaped horizontally extending rib is of a shape that allows a sterilizing agent to access an underside of the rib and that enables the sterilizing agent to be effectively removed from the container thereby improving the aseptic process of sterilizing the plastic container.

8. The plastic container according to claim 6, wherein the "m"-shaped horizontally extending rib is hoop shaped and the hoop shape strengthens the body of the filled plastic container so that the container resists deflection as it moves throughout a vending machine.

9. The plastic container according to claim 6, wherein the "m"-shaped horizontally extending rib is placed in a position along the body portion to provide the strongest hoop strength to the plastic container.

10. The plastic container according to claim 6, wherein the body portion has one of a round or square profile.

* * * * *